US010124983B2

(12) United States Patent
Merkel et al.

(10) Patent No.: US 10,124,983 B2
(45) Date of Patent: Nov. 13, 2018

(54) CREPE PAPER DISPENSER

(71) Applicants: Stephen Merkel, Beaver, PA (US); Karen Merkel, Beaver, PA (US)

(72) Inventors: Stephen Merkel, Beaver, PA (US); Karen Merkel, Beaver, PA (US)

( * ) Notice: Subject to any disclaimer, the term of this patent is extended or adjusted under 35 U.S.C. 154(b) by 253 days.

(21) Appl. No.: 15/146,477

(22) Filed: May 4, 2016

(65) Prior Publication Data

US 2017/0320697 A1 Nov. 9, 2017

(51) Int. Cl.
*B65H 49/32* (2006.01)

(52) U.S. Cl.
CPC ..... *B65H 49/322* (2013.01)

(58) Field of Classification Search
CPC ..... B65H 49/322
USPC ..... 242/588, 588.1, 588.3, 588.4, 560
See application file for complete search history.

(56) References Cited

U.S. PATENT DOCUMENTS 2,285,270 A 6/1942 Gelow
4,872,601 A * 10/1989 Sigmund ..... A47K 10/3836 225/38
D310,922 S * 10/1990 Sigmund ..... D6/520
D335,410 S * 5/1993 Abel ..... D6/520
5,265,816 A * 11/1993 Collins ..... A47K 10/3836 242/560
5,354,227 A 10/1994 Watkins
5,641,109 A * 6/1997 Willoughby ..... B65H 35/0026 224/162
5,702,284 A 12/1997 Gallegos
6,095,455 A * 8/2000 Green ..... A45F 5/02 24/3.12
6,364,245 B1 * 4/2002 Paal ..... A47K 10/3836 225/38
6,398,619 B1 6/2002 Webb
7,921,896 B2 4/2011 Anderson
8,540,182 B2 9/2013 Martineck, Sr.
2007/0034728 A1 * 2/2007 Moores ..... B65H 16/04 242/588.1
2007/0290094 A1 * 12/2007 Anderson ..... A47K 10/3836 242/594
2014/0090785 A1 4/2014 Nguyen

FOREIGN PATENT DOCUMENTS

WO WO2015066644 5/2015

* cited by examiner

*Primary Examiner* — Michael R Mansen
*Assistant Examiner* — Mark K Buse

(57) ABSTRACT

A streamer dispenser for dispensing crepe paper includes a housing. The housing has a front, a back and a sidewall extending from the back to the front defining an internal space. The front is open. A divider is coupled to the housing and is positioned in the internal space, defining a pair of compartments. A pair of slots is positioned through the sidewall of the housing. Each slot extends to a respective compartment. The compartments are positioned in the housing such that each compartment is configured for insertion of a respective roll of crepe paper. The slots are positioned in the housing such that each slot is configured for insertion of a free end of the respective roll of crepe paper. The free ends are positioned outside of the housing, such that the crepe paper is dispensable from the housing.

13 Claims, 3 Drawing Sheets

CREPE PAPER DISPENSER

BACKGROUND OF THE DISCLOSURE

Field of the Disclosure

The disclosure relates to dispensers and more particularly pertains to a new dispenser for dispensing crepe paper.

SUMMARY OF THE DISCLOSURE

An embodiment of the disclosure meets the needs presented above by generally comprising a housing. The housing has a front, a back and a sidewall extending from the back to the front defining an internal space. The front is open. A divider is coupled to the housing and is positioned in the internal space, defining a pair of compartments. A pair of slots is positioned through the sidewall of the housing. Each slot extends to a respective compartment. The compartments are positioned in the housing such that each compartment is configured for insertion of a respective roll of crepe paper. The slots are positioned in the housing such that each slot is configured for insertion of a free end of the respective roll of crepe paper. The free ends are positioned outside of the housing, such that the crepe paper is dispensable from the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
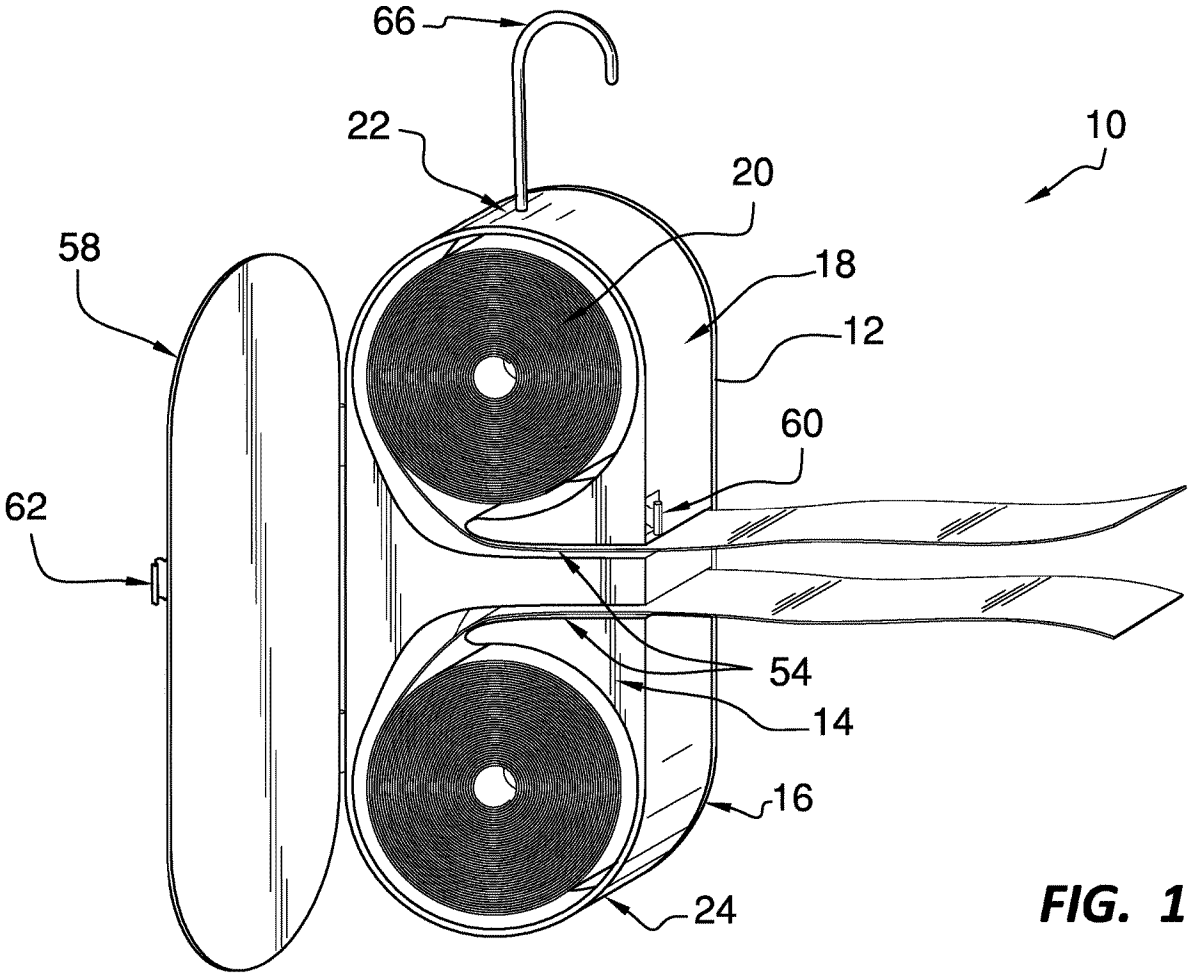
FIG. 1 is an in-use view of a streamer dispenser according to an embodiment of the disclosure.
Figure 2:
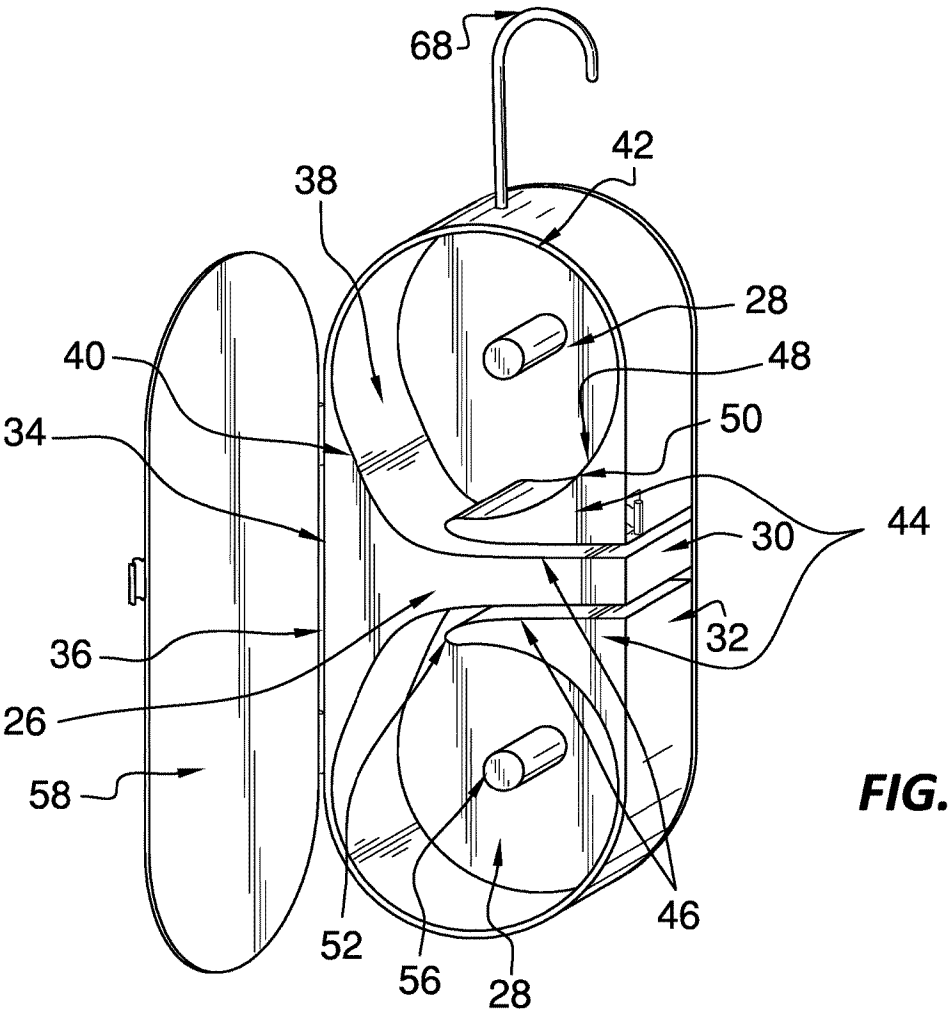
FIG. 2 is an isometric perspective view of an embodiment of the disclosure.
Figure 3:
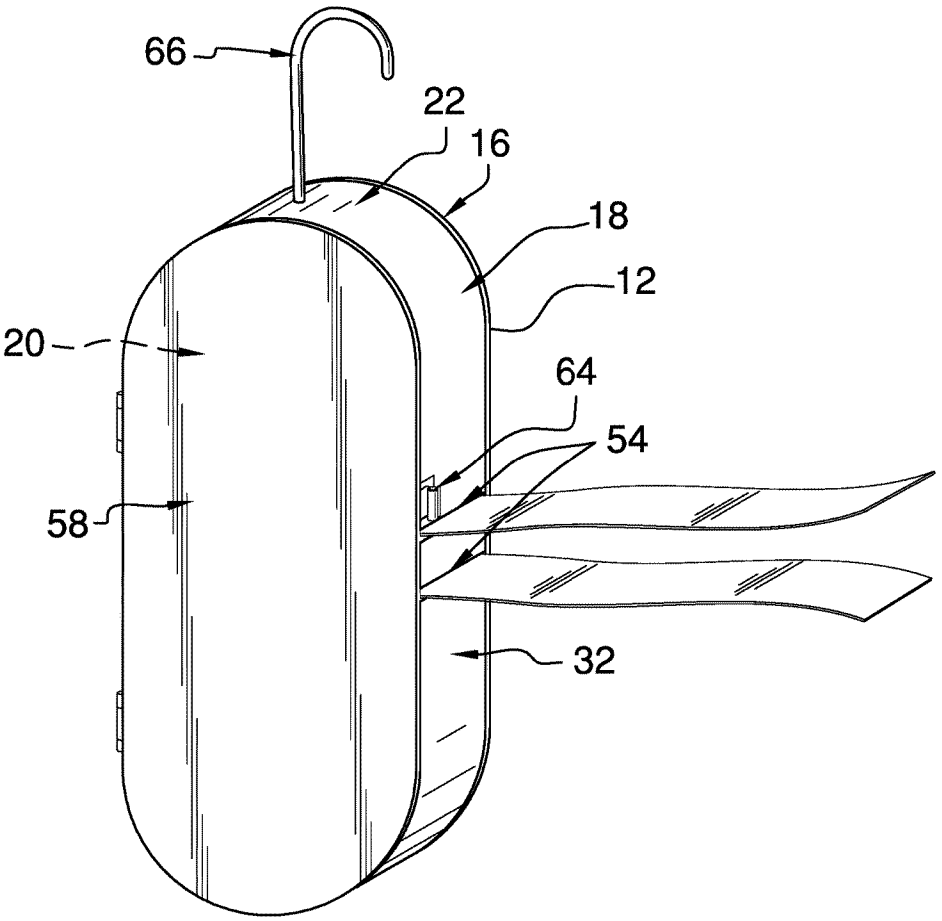
FIG. 3 is a front view of an embodiment of the disclosure.

With reference now to the drawings, and in particular to FIGS. 1 through 3 thereof, a new dispenser embodying the principles and concepts of an embodiment of the disclosure and generally designated by the reference numeral 10 will be described.

As best illustrated in FIGS. 1 through 3, the streamer dispenser 10 generally comprises a housing 12. The housing 12 has a front 14, a back 16 and a sidewall 18 that extends from the back 16 to the front 14, defining an internal space 20. The front 14 is open. The housing 12 has a top 22 and a bottom 24. The top 22 and the bottom 24 are rounded.

A divider 26 is coupled to the housing 12 and is positioned in the internal space 20 and defines a pair of compartments

28. The compartments 28 are substantially equally dimensioned. The divider 26 has a first end 30 coupled to a first side 32 of the housing 12 and a second end 34 coupled to a second side 36 of the housing 12. The second end 34 comprises a pair of first curves 38. Each first curve 38 defines a first portion 40 of a perimeter 42 of a respective compartment 28.

A pair of abutments 44 is coupled to and extends from the first side 32 of the housing 12 into the internal space 20. Each abutment 44 is positioned proximate to a respective opposing face 46 of the divider 26. Each abutment 44 has a second curve 48 that defines a second portion 50 of the perimeter 42 of the respective compartment 28. Each abutment 44 has a tip 52 that is distal from the first side 32. The tip 52 is rounded.

A pair of slots 54 is positioned through the sidewall 18 of the housing 12. Each slot 54 extends to a respective compartment 28. Each slot 54 is defined by a respective abutment 44 and the divider 26.

A pair of rods 56 is coupled and extends perpendicularly from the back 16 of the housing 12 into the internal space 20. Each rod 56 is complementary to the tubular core of the roll of crepe paper. Each rod 56 is substantially centrally positioned in the respective compartment 28. The rod 56 is positioned in the respective compartment 28 such that the rod 56 is configured to insert into the tubular core of respective roll of crepe paper. The respective roll of crepe paper is retained substantially centrally positioned with the respective compartment 28.

The dispenser 10 includes a door 58 that is complementary to the front 14 of the housing 12. The door 58 is hingedly coupled to the second side 36 of the housing 12 adjacent to the front 14 of the housing 12.

A first coupler 60 is coupled to the first side 32 of the housing 12 proximate to the respective slot 54. A second coupler 62 is coupled to the door 58. The second coupler 62 is complementary to the first coupler 60. The second coupler 62 is positioned on the door 58 such that the second coupler 62 is positioned to couple to the first coupler 60 to secure the door 58 in a closed position. In one embodiment, the first coupler 60 and the second coupler 62 comprise a clasp closure 64.

A fastener 66 is coupled to the top 22 of the housing 12. The fastener 66 is positioned on the housing 12 such that the fastener 66 is configured to couple the housing 12 to a surface. The fastener 66 is positioned on the top 22 substantially equally distant from the front 14 and the back 16 of the housing 12. In one embodiment, the fastener 66 comprises a hook 68.

In use, the compartments 28 are positioned in the housing 12 such that each compartment 28 is configured for insertion of a respective roll of crepe paper. The slots 54 are positioned in the housing 12 such that each slot 54 is configured for insertion of a free end of the respective roll of crepe paper. The free ends are positioned outside of the housing 12, such that the crepe paper is dispensable from the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A dispenser comprising:

a housing having a front, a back and a sidewall extending from said back to said front defining an internal space, said front being open;

a divider coupled to said housing and positioned in said internal space defining a pair of compartments, said divider having a first end coupled to a first side of said housing and a second end coupled to a second side of said housing, said second end comprising a pair of first curves, each said first curve defining a first portion of a perimeter of a respective said compartment;

a pair of abutments coupled to and extending from said first side of said housing into said internal space, each said abutment being positioned proximate to a respective opposing face of said divider, each said abutment having a second curve defining a second portion of said perimeter of said respective said compartment;

a pair of slots positioned through said sidewall of said housing, each said slot extending to a respective said compartment; and wherein said compartments are positioned in said housing such that each said compartment is configured for insertion of a respective roll of crepe paper, wherein said slots are positioned in said housing such that each said slot is configured for insertion of a free end of the respective roll of crepe paper, such that the free ends are positioned outside of said housing and wherein the crepe paper is dispensable from said housing.

2. The dispenser of claim 1, further including said housing having a top and a bottom, said top and said bottom being rounded.

3. The dispenser of claim 1, further including said compartments being substantially equally dimensioned.

4. The dispenser of claim 1, further including each said abutment having a tip, said tip being distal from said first side, said tip being rounded.

5. The dispenser of claim 1, further including each said slot being defined by a respective said abutment and said divider.

6. The dispenser of claim 1, further including a pair of rods coupled to and extending perpendicularly from said back of said housing into said internal space, each said rod being complementary to the tubular core of the roll of crepe paper, each said rod being substantially centrally positioned in said respective said compartment, wherein each said rod is positioned in said respective said compartment such that said rod is configured for insertion into the tubular core of respective roll of crepe paper, such that the respective roll of crepe paper is retained substantially centrally positioned with said respective said compartment.

7. The dispenser of claim 1, further including a door complementary to said front of said housing, said door being hingedly coupled to a second side of said housing adjacent to said front of said housing.

8. The dispenser of claim 7, further comprising:

a first coupler coupled to a first side of said housing proximate to a respective said slot;

a second coupler coupled to said door, said second coupler being complementary to said first coupler; and wherein said second coupler is positioned on said door such that said second coupler is positioned to couple to said first coupler to secure said door in a closed position.

9. The dispenser of claim 8, further including said first coupler and said second coupler comprising a clasp closure.

10. The dispenser of claim 1, further including a fastener coupled to a top of said housing, wherein said fastener is positioned on said housing such that said fastener is configured to couple said housing to a surface.

11. The dispenser of claim 10, further including said fastener being positioned on said top substantially equally distant from said front and said back of said housing.

12. The dispenser of claim 10, further including said fastener comprising a hook.

13. A dispenser comprising:

a housing having a front, a back and a sidewall extending from said back to said front defining an internal space, said front being open, said housing having a top and a bottom, said top and said bottom being rounded;

a divider coupled to said housing and positioned in said internal space defining a pair of compartments, said compartments being substantially equally dimensioned, said divider having a first end coupled to a first side of said housing and a second end coupled to a second side of said housing, said second end comprising a pair of first curves, each said first curve defining a first portion of a perimeter of a respective said compartment;

a pair of abutments coupled to and extending from said first side of said housing into said internal space, each said abutment being positioned proximate to a respective opposing face of said divider, each said abutment having a second curve defining a second portion of said perimeter of said respective said compartment, each said abutment having a tip, said tip being distal from said first side, said tip being rounded;

a pair of slots positioned through said sidewall of said housing, each said slot extending to a respective said compartment, each said slot being defined by a respective said abutment and said divider;

a pair of rods coupled to and extending perpendicularly from said back of said housing into said internal space, each said rod being complementary to the tubular core of the roll of crepe paper, each said rod being substantially centrally positioned in said respective said compartment, wherein each said rod is positioned in said respective said compartment such that said rod is configured for insertion into the tubular core of respective roll of crepe paper, such that the respective roll of crepe paper is retained substantially centrally positioned with said respective said compartment;

a door complementary to said front of said housing, said door being hingedly coupled to said second side of said housing adjacent to said front of said housing;

a first coupler coupled to said first side of said housing proximate to said respective said slot;

a second coupler coupled to said door, said second coupler being complementary to said first coupler, wherein said second coupler is positioned on said door such that said second coupler is positioned to couple to said first coupler to secure said door in a closed position, said first coupler and said second coupler comprising a clasp closure;

a fastener coupled to said top of said housing, wherein said fastener is positioned on said housing such that said fastener is configured to couple said housing to a surface, said fastener being positioned on said top substantially equally distant from said front and said back of said housing, said fastener comprising a hook;

wherein said compartment are positioned in said housing such that each said compartment is configured for insertion of a respective roll of crepe paper, wherein said slots are positioned in said housing such that each said slot is configured for insertion of a free end of the respective roll of crepe paper, such that the free ends are positioned outside of said housing and wherein the crepe paper is dispensable from said housing.

* * * * *